United States Patent [19]

Cudzik

[11] 3,967,752

[45] July 6, 1976

[54] EASY-OPEN WALL

[75] Inventor: Daniel F. Cudzik, Richmond, Va.

[73] Assignee: Reynolds Metals Company, Richmond, Va.

[22] Filed: Nov. 24, 1975

[21] Appl. No.: 634,755

Related U.S. Application Data

[63] Continuation-in-part of Ser. Nos. 592,232, July 1, 1975, Ser. No. 529,461, Dec. 4, 1974, abandoned, Ser. No. 519,992, Nov. 1, 1974, Ser. No. 506,453, Sept. 16, 1974, abandoned, Ser. No. 492,033, July 26, 1974, Ser. No. 488,805, July 15, 1974, Ser. No. 378,448, July 12, 1973, abandoned, and Ser. No. 293,115, Sept. 28, 1972, Pat. No. 3,836,038, said Ser. No. 592,232, is a continuation of Ser. No. 506,453, , said Ser. No. 529,461, is a continuation-in-part of Ser. No. 519,992, , Ser. No. 492,033, , Ser. No. 378,448, , and Ser. No. 293,115, , said Ser. No. 492,033, is a continuation-in-part of Ser. No. 378,448, , and Ser. No. 293,115, , said Ser. No. 378,448, is a continuation-in-part of Ser. No. 293,115.

[52] U.S. Cl. ..... 220/269

[51] Int. Cl.[2] ..... B65D 41/32

[58] Field of Search ..... 220/268, 269, 270–273

[56] References Cited

UNITED STATES PATENTS

| | | | |
|---|---|---|---|
| 3,446,389 | 5/1969 | Brown | 220/269 |
| 3,730,379 | 5/1973 | Brown | 220/269 |
| 3,744,667 | 7/1973 | Fraze et al. | 220/269 |
| 3,813,000 | 5/1974 | Underwood | 220/269 |
| 3,843,011 | 10/1974 | Perry | 220/269 X |

*Primary Examiner*—George T. Hall

*Attorney, Agent, or Firm*—Glenn, Palmer, Lyne, Gibbs & Clark

[57] ABSTRACT

An easy-open construction for a container wherein a panel principally defined by a rupturable score line in a wall is opened by operating a tab having one end adapted to press against the panel at a position spaced from the score line and overlying only a small portion of the opening left by the panel in its opened position. The other end of the tab is liftable to open the panel and is returnable directly to its original position next to the wall. The tab and panel remain secured to the wall after the panel has been moved to its open position.

32 Claims, 30 Drawing Figures

EASY-OPEN WALL

CROSS REFERENCE TO RELATED APPLICATIONS

This application is a continuation-in-part of the following applications of applicant which are co-pending or have continuing subject matter in the listed co-pending applications: Ser. No. 293,115 filed Sept. 28, 1972 (now U.S. Pat. No. 3,836,038 issued Sept. 17, 1974); Ser. No. 378,448 filed July 12, 1973 (now abandoned, a continuation-in-part of Ser. No. 293,115); Ser. No. 492,033 filed July 26, 1974 (a continuation-in-part of Ser. Nos. 293,115 and 378,448); Ser. No. 519,992 filed Nov. 1, 1974; Ser. No. 529,461 filed Dec. 4, 1974 now abandoned (continuation-in-part of Ser. Nos. 293,115, 378,448, 492,033 and 519,992); Ser. No. 488,805 filed July 15, 1974; Ser. No. 506,453 filed Sept. 16, 1974 (now abandoned); and Ser. No. 592,232 filed July 1, 1975 (continuation of Ser. No. 506,453). All portions of the disclosures of said patent and applications are incorporated herein and made a part hereof.

BACKGROUND OF THE INVENTION

Large numbers of containers, particularly beverage cans, are conventionally opened by pulling off a tear strip which is removable together with the attached ring tab. The severed tear strip with attached tab may be carelessly discarded with undesirable consequences, such as litter and a hazard to bare feet. Moreover, many cans with easy-open ends of this sort are made of aluminum alloys which can be produced with less expenditure of energy through recycling than from the original ore, and the metal in the tear strip and tab are more readily collected and recycled if the tear strip and tab remain with the can body after opening of the can.

The container industry is highly competitive and has long made serious efforts to design easy-open can ends, particularly of the kind used to contain beer and carbonated beverages, so that the tear strips and tabs could be secured non-detachably while still remaining convenient to operate and use, and free of substantial cost penalties. These efforts have produced many designs, but none before the present invention appears to have provided a solution of the problem unaccompanied by one or more difficulties which make the design as a whole commercially unsatisfactory.

SUMMARY

The present invention has several aspects in the light of which improved easy-open container constructions are provided to meet the objectives mentioned above. More particularly, the invention provides constructions wherein the tab for opening a panel in a container wall is capable of having one end pressed against the panel to open it wide without putting the tab in a position where it will obstruct more than a small portion of the opening left by the panel in its open position. Furthermore, the tab nose is positioned in accordance with the invention away from any rupturable score line, thereby reducing the chances of inadvertent rupture through pressure on the tab during storage and transportation. The invention further teaches initiation of rupture of the score line adjacent the rivet or the like securing the tab to the container wall, and completing rupture through propagation of the initial crack away from adjacent the rivet position and then around and back again to leave only a small unbroken part of the wall to hinge the panel. The means securing the tab to the container wall is secured to the wall outside the area of the removable panel, with some play preferably provided to permit the liftable end of the tab to be raised conveniently preliminary to initial rupture of the score line.

The opening construction of the invention requires a tab which must be stiff against transverse bending and yet flexible and tough enough at the connection between the tab and end wall to permit lifting and retracting the tab without causing a fatigue crack at the connection. The invention provides a tab construction meeting these requirements. It is particularly adapted to be used in conjunction with the applicant's novel opening construction, but may also have application in other opening constructions. While some non-aluminous materials, such as steel, may permit design of a tab for this purpose which is all of one material, such an approach would be incompatible with the objective of recycling all-aluminum cans with non-detachable tabs. Since no one alloy and temper of aluminum fully combines the desired tab properties for the present purpose, applicant's invention provides a composite construction permitting selection of a stiff material, preferably aluminum strengthened by alloying and by cold work or heat treatment, to resist transverse bending of the tab, and a material of sufficient strength while capable of repeated flexing, preferably a low temper aluminum alloy, to connect the tab to the can end wall. Such flexible material can be a plastic, preferably one which would decompose at the temperatures required for melting aluminum for recycling purposes. However, such a plastic could pose an air pollution problem in the course of recycling a can otherwise made of aluminum. Accordingly, the preferred composite tab construction of the invention has all of its elements made of aluminum alloys. As used herein, the term "aluminous" metal or material refers to aluminum alloys, and the term "aluminum alloy(s)" refers to commercial purity aluminum and alloys containing more than 50 percent aluminum.

Other details, uses, and advantages of this invention will become apparent as the following description of the exemplary embodiments thereof presented in the accompanying drawings proceeds.

BRIEF DESCRIPTION OF THE DRAWINGS

The accompanying drawings show exemplary embodiments of this invention, in which.

DESCRIPTION OF ILLUSTRATED EMBODIMENTS

Figure 1:
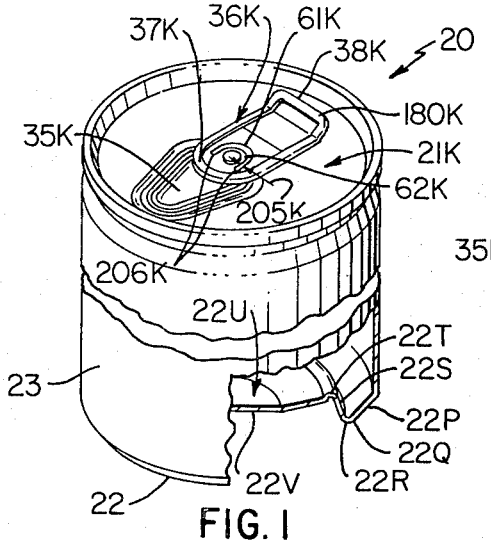
FIG. 1 is a perspective view of an exemplary container of this invention with the central and a bottom portion thereof broken away and illustrating an easy-open wall of this invention provided as a top wall of such container.

Reference is now made to FIGS. 1–13 of the drawings, which illustrate one exemplary embodiment of a container, designated generally by the reference numeral 20 and which utilizes an easy-open wall in the form of a top wall 21K which is made in accordance with the teachings of this invention. The remainder of container 20 may be of any suitable conventional construction and includes a bottom wall 22 adjoined by a substantially right circular cylindrical side wall 23, and the bottom wall 22 and side wall 23 may be provided as a single piece construction or may be made of a plurality of pieces in accordance with known manufacturing techniques.

As shown, the bottom wall 22 has a substantially frustoconical portion 22P adjoining the lower end of the side wall 23 and extending downwardly, with the container 20 positioned as illustrated in FIG. 1 toward the central longitudinal axis of the container. The bottom wall has an outwardly convex bottom bead 22Q adjoining the frustoconical portion 22P with the bottom bead 22Q having a bottom supporting edge 22R which is arranged in a single plane; and, the bottom wall 22 also has a second frustoconical portion 22S adjoining the bottom bead 22R and extending upwardly therefrom toward the longitudinal axis of the container 20. The bottom wall also has a substantially semitoroidal inwardly convex bead 22T adjoining the frustoconical portion 22S; and, the bottom wall 22 is completed by what will be described as a dished portion 22U adjoining the semitoroidal bead with the dished portion having a flat central part 22V.

Figure 3:
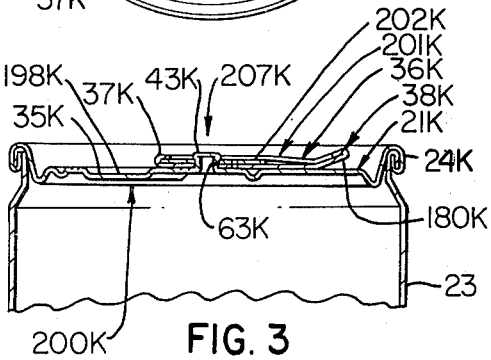
FIG. 3 is a fragmentary cross-sectional view taken essentially on the line 3—3 of FIG. 2.

The top wall 21K may be fastened to the top portion of the side wall 23 using any suitable technique and in this example the top portion of the side wall 23 is necked inwardly to produce a smaller diameter tubular portion at the top of wall 23 and thereby enable top wall 21K to be fastened in position by a simple mechanical swaging technique to produce a top annular bead on the container as illustrated at 24K in FIG. 3, with such bead being within the circumferential outline of the cylindrical side wall 23, as shown.

Figure 4:
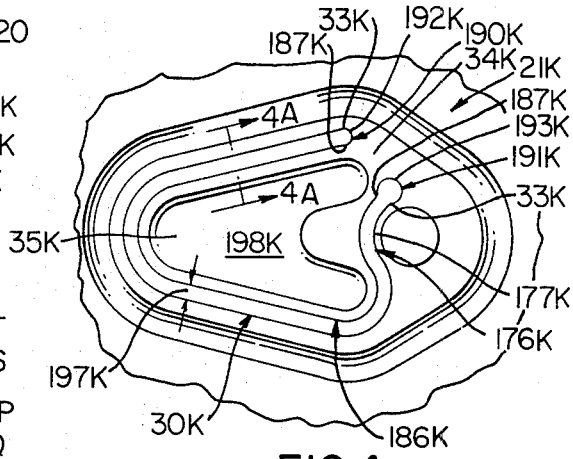
FIG. 4 is a fragmentary plan view of the central portion of the top wall of the container of FIG. 1 drawn to an enlarged scale and minus the push tab.
Figure 2:
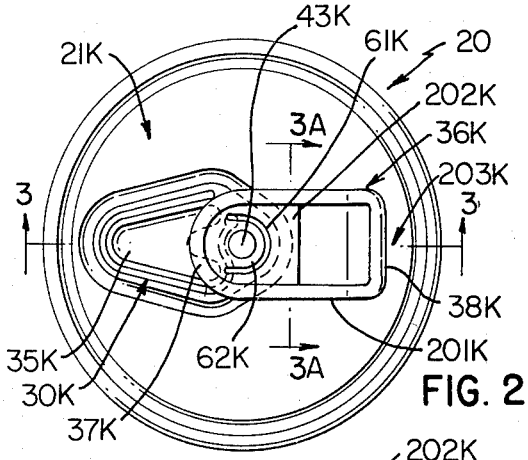
FIG. 2 is a view looking perpendicularly toward the top wall of the container of FIG. 1.
Figure 13:
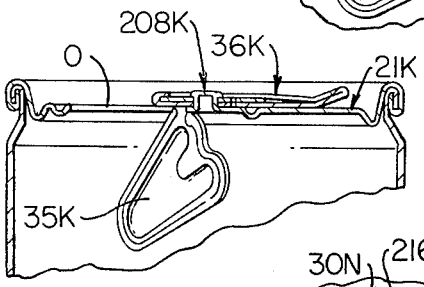
FIG. 13 is a fragmentary cross-sectional view taken essentially on the line 13—13 of FIG. 12.

As best seen in FIG. 4, the wall 21K has formed therein a continuous score means such as a score line designated generally by the reference numeral 30K and defining most of the periphery of a non-removable tear panel 35K which is partially severable from the wall to define an opening 0 therein as seen in FIG. 13, for example. The wall 21K has a tab 36K which is attached thereto in a non-detachable manner outwardly of the panel 35K and the tab has a forward portion or part 37K which overlies only a minor part of the panel 35K, as shown, and has a rear portion or part 38K which is adapted to be easily grasped and lifted to urge the forward portion 37K against the panel 35K and move such panel 35K transverse to the wall 21K with a wall portion 34K (or portion of the wall 21K) holding the panel securely thereto and defining a bend area or integral hinge between the panel and the remainder of the end wall. The length of this hinge will be seen to be substantially less than the maximum dimension of the tear panel.

The score line 30K extends in a continuous curvilinear, i.e., non-rectilinear, path and terminates in what will be referred to as spaced ends 33K. The score line 30K has an undulating or curved portion which is designated generally by the reference numeral 176K adjacent, in this example adjoining, one of the spaced ends 33K with the spaced ends having the previously mentioned wall portion 34K of the wall therebetween. The undulating portion 176K has a valley portion 177K and the undulating portion 176K cooperates with the remainder of the score line 30K to define the panel 35K.

The wall 21K has means for attaching the tab 36K substantially flatly against (that is, generally parallel and close to the underlying area of) the end wall and such attaching means of this example is in the form of a rivet 43K, preferably defined as an integral part of the wall 21K. As seen in FIG. 3, the rear portion 38K of the tab 36K has an upwardly inclined terminal portion 180K to facilitate grasping or lifting thereof whereby upon lifting the rear portion 38K of the tab 36K, the forward portion 37K moves down so as to engage the panel and initially rupture or sever the panel 35K from approximately one of the spaced ends 33K and along the undulating portion 176K; and, this initial rupturing or severing is achieved upon lifting the tab essentially to the position illustrated at 181K in FIG. 6.

Figure 5:
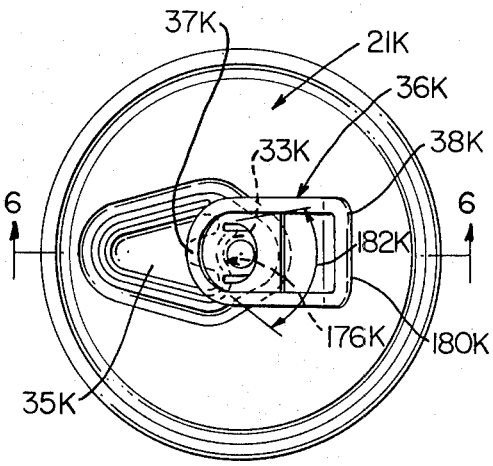
FIG. 5 is a top plan view illustrating the tab comprising the top wall of the container of FIG. 1 partially lifted to thereby commence severing of the panel along an undulating portion of a score line defining such panel.
Figure 11:
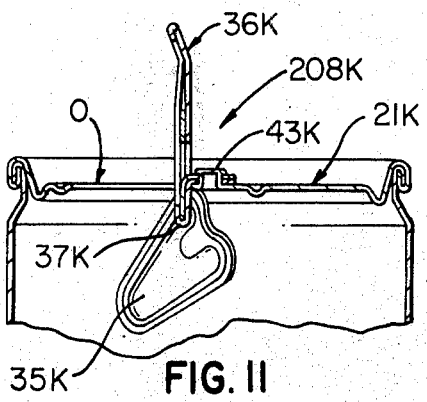
FIG. 11 is a fragmentary cross-sectional view taken essentially on the line 11—11 of FIG. 10.

This initial severing may be considered as extending along a severed length which is confined within an approximate arc as illustrated at 182K in FIG. 5. Continued lifting of the tab 36K to the position illustrated at 183K in FIG. 8 results in severing along a length which is confined within a comparatively larger approximate arc as indicated at 184K in FIG. 7. Continued lifting of the tab through a comparatively small angular increment so that it is in a substantially vertical position as shown in FIG. 11 results in substantially instantaneous severing of the remainder of the scored portion of the panel in what might be considered a snap action whereupon the panel 35K is arranged transverse and indeed roughly perpendicular the plane of the wall 21K. However, it is to be understood that while the above description has proceeded as if the severing of panel 35K is achieved in incremental steps, or the like, it is to be understood that such severing is usually achieved in one smooth motion producing a "snap-opening" of the wall 21K.

Figure 12:
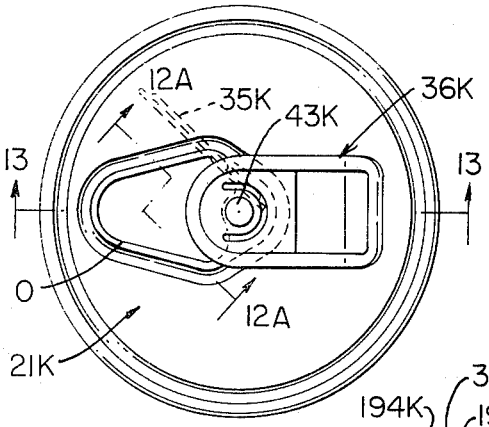
FIG. 12 is a view similar to FIG. 2, illustrating the tab returned to its original position flatly against the top wall.
Figure 15:
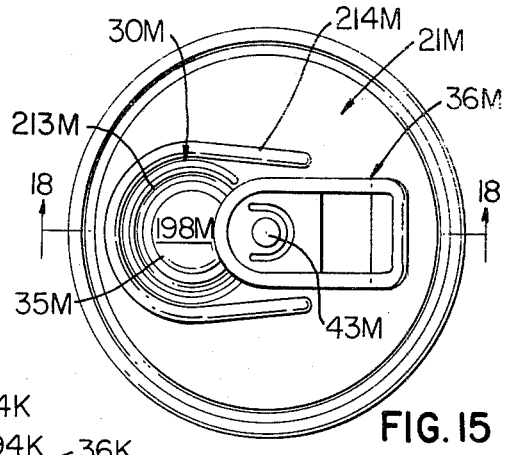
FIG. 15 is a view similar to FIG. 2 illustrating another exemplary embodiment of an easy-open top wall which may be used interchangeably with the top wall illustrated on any container disclosed in this application.

The tab 36K is then returned from its substantially vertical position to a horizontal or substantially horizontal position as indicated in FIGS. 12 and 13 whereupon the severed panel 35K remains attached to the wall 21K at a comparatively remote position near the center of the wall 21K such that there may be unobstructed pouring of the contents of the container 20. Further, any suitable fastening means may be provided to fasten the tab 36K flatly against the top wall 21K and such fastening means may be of any suitable type.

The wall 21K has the continuous score line 30K which terminates in spaced ends 33K, as best seen in FIG. 4; and, the spaced ends 33K have the wall portion 34K therebetween as noted. The wall 21K further comprises an anti-fracture score line 186K which is arranged within the confines of the score line 30K and the anti-fracture score line 186K terminates in spaced ends 187K which are arranged closely adjacent the spaced ends 33K of the score line 30K. In particular, it will be seen that one of the ends 187K is arranged closely adjacent one of the ends of the score line 30K to define a first set 190K of ends and the other of the ends 187K of the anti-fracture score line is arranged closely adjacent the other of the ends 33K of the score line 30K to define a second set 191K of ends.

Figure 12A:
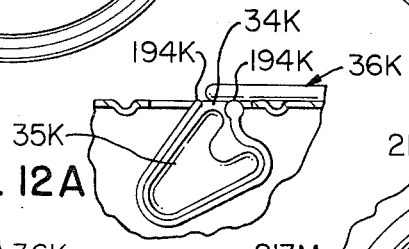
FIG. 12A is a fragmentary cross-sectional view taken essentially on the line 12A—12A of FIG. 12.

The wall 21K also has what will be referred to as a first closing score line 192K extending between the first set 190K of ends and a second closing score line 193K extending between the second set 191K of ends. The closing score lines 192K and 193K cooperate with the score line 30K and the anti-fracture score line 186K to assure precision severing of the panel 35K while holding the panel at the wall portion 34K along transition portions which will be referred to as rounded transition portions and each designated by the reference numeral 194K in FIG. 12A. The rounded transition portions 194K assure that the panel 35K is held substantially free at those points of undesirable tears of the type which might be produced if closing score lines 192K and 193K were not present.

Figure 4A:
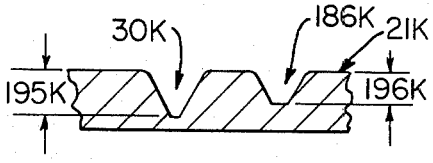
FIG. 4A is a fragmentary cross-sectional view taken essentially on the line 4A—4A of FIG. 4.

It will also be appreciated that the closing score lines 192K and 193K have suitable depths so that the residual metal remaining therebeneath along their lengths is precisely controlled. In this example, the score lines 192K and 193K gradually decrease in depth from the maximum depth of the score line as indicated at 195K, in the greatly enlarged view of FIG. 4A, to the reduced depth of the anti-fracture score line at 196K. However, the depths of the closing score lines 192K and 193K may be the same throughout their lengths or may be any desired depth for each.

The anti-fracture score line 186K corresponds in configuration to the configuration of the score line 30K as mentioned previously and the anti-fracture score line 186K is equally spaced from the score line 30K about the entire periphery of such score line 30K by a particular distance 197K. The closing score line 192K of this example is approximately semicircular and has a diameter approximately equal to the particular distance 197K. Similarly, the closing score line 193K extends in an approximately circular path having a diameter greater than the particular distance 197K so that the closing score line 193K defines what may be considered a bulbous end between the second set of ends illustrated at 191K.

The wall 21K has a main portion which, as will be readily apparent from the drawings, preferably is formed so as to be substantially in one plane, prior to being seamed to the side wall of a container. It will also be seen particularly from FIGS. 3 and 4, that the panel 35K has embossing means which in this example is in the form of a single embossment 198K therein serving as a strengthening and force transmitting structure and assuring easier severing of the panel 35K. The embossing means 198K may have any suitable peripheral outline and instead of being a single embossment may be in the form of a plurality of embossments. Further, the embossing means of this example has a peripheral outline which corresponds approximately with the outline of the score line 30K, and hence the anti-fracture score line 186K, and the embossing means 198K is in the form of a depressed portion as illustrated at 200K which extends beneath the plane of the main portion of the wall 21K. The embossing means may also be in the form of a single raised portion corresponding to the outline of depressed embossment 198K, as will be evident.

The tab 36K may be made of either a single piece or a plurality of pieces of material, either metallic or non-metallic, and in the case of metallic material may be made of either ferrous or non-ferrous metal. However, such tab 36K is preferably in the form of a laminated or composite, two-piece construction made of a plurality of aluminous metal components which are suitably held together. In particular, and as illustrated in FIGS. 2, 3, 3A and 3B, for example, the laminated tab 36K may comprise an outer structural member 201K and an inner member or insert 202K fixed within the outer structural member. Components 201K and 202K preferably are made of aluminous metal, as indicated above, with the outer member 201K being selected because of its structural strength and the inner member or insert 202K being selected because of its capability of being flexed or bent sharply several times, if desired, without breaking into two tab parts.

Figure 3A:
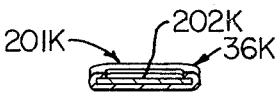
FIG. 3A is a fragmentary cross-sectional view taken essentially on the line 3A—3A of FIG. 2 particularly illustrating the laminated two-piece construction of the tab which is made of a metallic inner part and a metallic outer part.
Figure 3B:
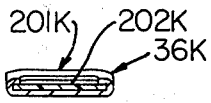
FIG. 3B is a view similar to FIG. 3A showing a modification of the tab of FIG. 3A which has an inner part made of plastic.

It will also be appreciated that the tab 36K may have its outer structural member 201K made of a metallic material and the insert made of a suitable plastic material also designated 202K and as illustrated by suitable cross-hatching in FIG. 3B. The plastic material is also selected so that the tab may be flexed or bent sharply several times without breaking of the tab into two tab parts.

The score line 30K and panel 35K defined thereby are shown as being symmetrical about a common longitudinal axis; and, the tab 36K has a longitudinal axis which is arranged parallel to and in vertically aligned relation above the longitudinal axis of the score line and panel. Indeed, as will be apparent from FIG. 2, the common longitudinal axis of the score line 30K and panel 35K is a diametral line which coincides with the section line 3—3 as indicated at 203K.

The laminated tab 36K may be attached to the wall 21K in any suitable manner; however, as seen in FIGS. 1 and 3, such tab has a roughly U-shaped cut or slit which will be designated generally by the reference numeral 61K to define an attachment area 62K therewithin. The attachment area 62K has an opening 63K therethrough for receiving a rivet 43K used to fasten the tab 36K to the wall 21K in conventional fashion. The cut 61K is shown as having a relatively substantial width as indicated at 205K and is provided with a pair of substantially semicircular ends 206K defining an imaginary bend line for the attachment area 62K and hence the tab 36K.

The rivet 43K is defined as an integral part of the wall 21K in accordance with techniques well known in the art; and, the rivet 43K is defined and arranged so that it remains substantially in the same position upon returning tab 36K toward its original position after severing the panel 35K. For example, the position of the rivet may be readily observed at 207K in FIG. 3 prior to severing of the panel 35K. After severing the panel essentially in the manner illustrated in FIGS. 5–11, and returning the tab substantially flatly against the top wall 21K in the manner illustrated in FIG. 13, the unique composite construction of the tab not only assures that the tab will not break in two tab parts but also assures that the rivet 43K remains substantially intact and in the position shown at 207K in FIG. 3 as will be seen in 208K in FIG. 13.

In the example illustrated in FIGS. 1–13 the score line 30K and anti-fracture score line 186K are approximately heart-shaped and it will be seen that the spaced ends 33K adjacent the wall portion 34K are arranged adjacent the top corner of what would be considered a top corner of the heart-shaped score line 30K. However, it will be appreciated that the concept of this invention may be provided with easy-open walls having score lines which have other configurations, such as those referred to hereinbelow.

Figure 14:
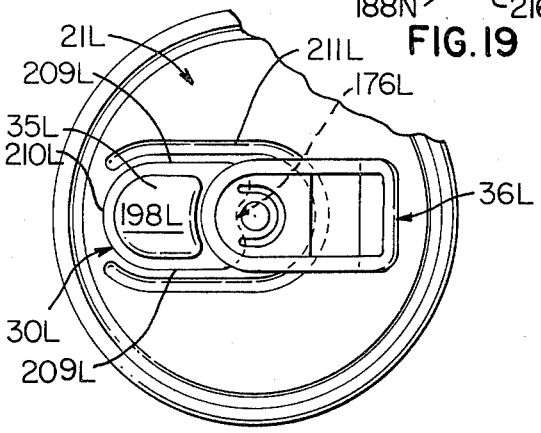
FIG. 14 is a view similar to FIG. 2 illustrating another exemplary embodiment of an easy-open top wall of this invention which may be used interchangeably with the top wall illustrated on any container disclosed in this application.
Figure 17:
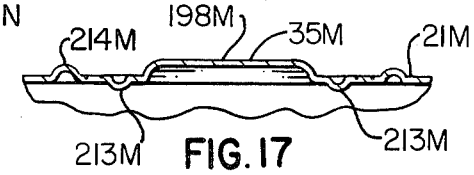
FIG. 17 is a fragmentary cross-sectional view taken essentially on the line 17—17 of FIG. 16.
Figure 18:
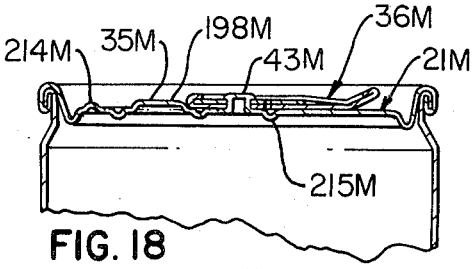
FIG. 18 is a view similar to FIG. 11 and taken along line 18—18 of FIG. 15.

For example, a modification of the easy-open wall of this invention is illustrated in FIG. 14 and designated by reference numeral 21L wherein a roughly heart-shaped score line 30L is provided without an anti-fracture score line, although it will be appreciated that a score line similar to score line 186K may be provided together with associated closing score lines as described above. The score line 30L of wall 21L has an undulating portion 176L and side portions 209L which are roughly parallel. The bottom portions of the side portions 209L are joined by a roughly semicircular portion 210L which extends through an arc of approximately 180°.

The panel 35L of wall 21L also has embossing means 198L therein and such embossing means is recessed inwardly beneath the main plane of the wall 21L. In addition, the wall 21L has an inwardly extending strengthening bead structure 211L of roughly U-shaped configuration and such wall uses a tab 36L which is substantially identical to the tab 36K of wall 21K.

Still another modification of the wall 21K is illustrated in FIGS. 15–18 and designated by the reference numeral 21M with similar reference numerals being used to indicate similar parts, as previously described; and, with new reference numerals, also followed by the reference letter M being used to designate substantially different parts or portions.

In particular, it will be seen that the part of the score line 30M which is arranged remote from the undulating portion 176M of such score line 30M extends in a circular path. Similarly, that part of the anti-fracture score line 186M which is arranged remote from its undulating portion 188M also extends in a corresponding circular path. Accordingly, it will be seen that the panel 35M may be considered a substantially circular panel which is easily severed in a similar manner as described in connection with the heart-shaped panel 35K of wall 21K. The panel 35M is easily severed by lifting the tab 36M substantially vertically in a similar manner as shown in FIG. 11 for the panel 35K to define an opening in the wall 21M whereupon the tab 36M is returned substantially flatly against the wall 21M whereby the contents of a container, such as container 20 of FIG. 1, for example, on which wall 21M may be installed may be poured therefrom in an unobstructed manner.

In a similar manner as in the wall 21K, the wall 21M has its score line 30M terminating in spaced ends 33M and the anti-fracture score line 186M terminates in spaced ends 187M similar to the spaced ends 187K of anti-fracture score line 186K. The ends 33M are spaced apart a small arcuate length less than 30° and generally of the order of 10° as shown at 212M in FIG. 16. In addition, closing score lines 192M and 193M are provided in a similar manner and as previously described in connection with closing score lines 192K and 193K in the wall 21K. It will also be seen that the score line 30M has an undulating portion 176M provided with a valley portion 177M within which at least a portion of the rivet 43M is nested and in a similar manner as the rivet 43K is nested within its associated valley portion 177K. The anti-fracture score line 186M also has an undulating portion 188M.

Wall 21M has further strengthening and force transmitting means therein which cooperate with embossing means 198M to assure efficient transmittal of severing forces once the tab 36M is lifted. It will be noted that the embossing means 198M is outwardly convex or is raised outwardly from the top wall 21M. In particular, such further means in wall 21M which assure more efficient transmittal of severing forces includes an inwardly convex bead 213M which surrounds raised embossment 198M of panel 35M and conforms roughly in configuration to panel 35M. The inwardly convex bead 213M is substantially circular throughout its peripheral outline except for a portion which is arranged beneath the tab 36M.

It will also be seen that the wall 21M has still another reinforcing means or reinforcement provided therein to give structural rigidity and integrity thereto; and, such reinforcement is in the form of a U-shaped outwardly convex ridge or bead 214M which extends around the entire panel 35M, tab 36M, and rivet 43M. In addition, wall 21M has reinforcing means in the form of an inwardly convex substantially rectilinear indentation 215M which is arranged outwardly of the rivet 43M and substantially within the confines of an imaginary line extending between the terminal ends of the substantially U-shaped outwardly convex strengthening ridge 214M.

Figure 16:
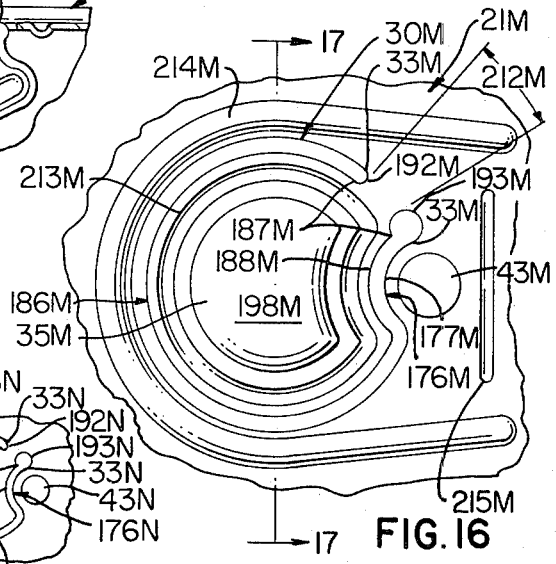
FIG. 16 is a view similar to FIG. 4 particularly illustrating the detailed construction of the severable panel of the easy-open wall of FIG. 15.
Figure 19:
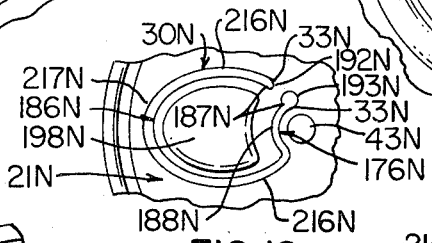
FIG. 19 is a view similar to FIG. 16 particularly illustrating a modification of the easy-open wall of FIGS. 15 and 16.

Still another modification of the wall 21K is illustrated in FIG. 19 of the drawings in a showing which is similar to FIG. 16 to highlight the details thereof. The wall of FIG. 19 is designated by the reference numeral 21N and with similar reference numerals being used to indicate parts which are similar to corresponding parts of the wall 21M. The wall 21N may also be used interchangeably with the wall 21M and all other walls disclosed herein which utilize the reference number 21 as the first part thereof.

The wall 21N of FIG. 19 has a score line 30N with spaced ends 33N, an anti-fracture score line 186N with spaced ends 187N, and closing score lines 192N and 193N. In addition, the wall 21N has an undulating portion 176N in its score line 30N and an undulating portion 188N in its anti-fracture score line 186N. Similarly, an integral rivet 43N is provided to fasten a tab 36N (not shown), which is substantially identical to the tab 36M, to the wall 21N.

In addition, the wall 21N has an outwardly convex portion 198N similar to portion 198M, a strengthening or structural bead similar to bead 213M, a strengthening bead similar to bead 214M, and an inwardly convex rectilinear embossment similar to embossment 215M. The main differences between the wall 21N and wall 21M are in the configurations of those parts of the score line 30N and anti-fracture score line 186N which are arranged remote from their respective undulating portions 176N and 188N. In particular, each of these remote portions extends in an elliptical path rather than a circular path. Thus, the elliptical path of score line 30N remote from undulating portion 176N has the usual oppositely arranged curved side portions 216N adjoined by curved end portion 217N; and, the elliptical path of anti-fracture score line 186N remote from its undulating portion 188N has portions corresponding to portions 216N and 217N while being arranged within the confines of these last two reference numerals as well as being equally spaced therefrom. It should also be noted that raised embossment 198N is substantially elliptical in outline and corresponds to the outlines of the score line 30N and the anti-fracture score line 186N.

It should be mentioned in connection with the severing action of panels 35K, 35L, 35M and 35N of walls 21K, 21L, 21M and 21N, respectively, that in each instance the rear portion of the associated tab is adapted to be easily grasped and lifted to urge the tab forward portion against its associated panel and simultaneously lift the associated attaching means and adjoining portions of the wall and thereby initially sever the panel along its undulating portion and thereafter sever the panel along at least a portion of the remainder of the score line adjoining the undulating portion by depressing the panel relative to its attaching means and adjoining portions of the wall.

Figure 20:
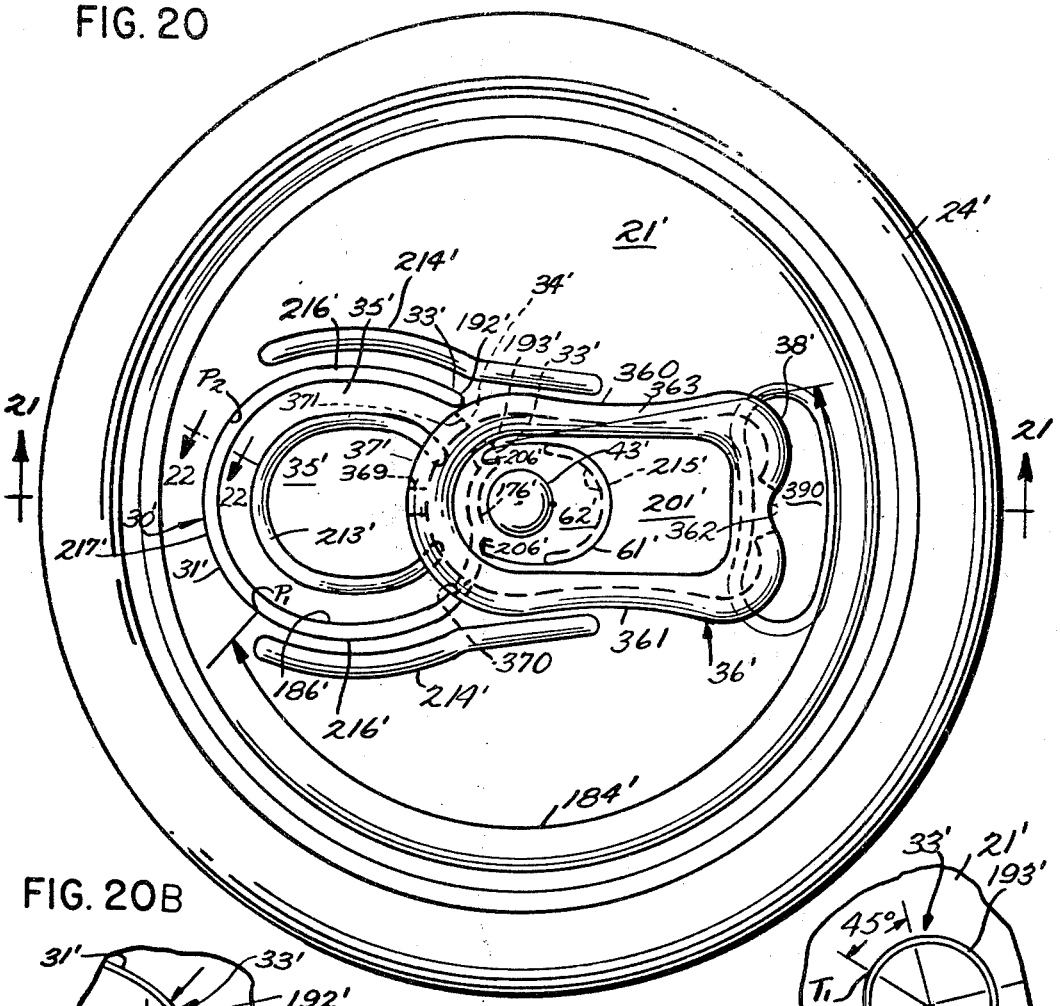
FIG. 20 is a top plan view of another embodiment of an easy-open end wall of this invention.
Figure 21:
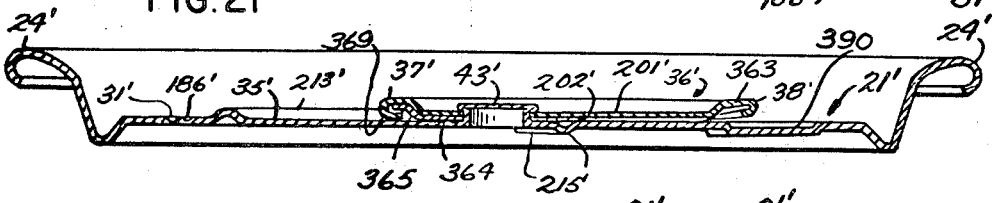
FIG. 21 is a sectional view taken along line 21—21 of FIG. 20.

FIGS. 20–25 of the drawings illustrate a currently preferred embodiment of an easy-open wall and non-detachable tab of this invention. The easy-open wall illustrated in FIGS. 20–21 is in the form of an end or top wall and is similar to the top walls 21K, 21L, 21M and 21N shown in FIGS. 1–19. Likewise, the non-detachable tab illustrated in FIGS. 20–25 is similar to the tab constructions 36K, 36L and 36M shown in FIGS. 1–18. Therefore, the easy-open wall and non-detachable tab of FIGS. 20–25 will be designated generally by the reference numerals 21' and 36', respectively, so as to avoid confusion with the other embodiments previously described. Parts of the wall 21' and tab 36' which are similar to corresponding parts of the walls 21K, 21L, 21M and 21N, and tabs 36K, 36L and 36M will be designated by the same reference numerals as in the case of the embodiments of FIGS. 1–19, but followed by the prime designation (') and, in general, described only as deemed appropriate.

The end wall 21' is suitably installed on a container (not shown in FIGS. 20–21) by having the flange 24' appropriately secured to the upper end of the container sidewall, as indicated, for example, in FIG. 3. The container may be made by any suitable process, and it may be made of any suitable material, such as aluminous metal, as is well known. Likewise, the easy-open end wall 21' may be made by any suitable process not forming part of the present invention, and, like end walls 21K, 21L, 21M and 21N, it may be made of any suitable metal, such as aluminum or ferrous alloys, but preferably is made of an aluminum alloy.

As best seen in FIG. 20, the wall 21' is provided with a continuous score line somewhat similar in outline to the score lines 30M and 30N shown in FIGS. 16 and 19, respectively. It will be seen, however, that score line 30' is not quite circular in outline as is score line 30M but it is somewhat more circular in outline at its outer end than the score line 30N. In this embodiment, the outer score line and the anti-fracture score line 186' are each of a uniform score residual thickness between the ends 33'. For an exemplary construction, and with reference to FIG. 22, the score residual thickness 195' of the outer rupturable score line 31' is about 0.005 inches and the score residual thickness 196' of the anti-fracture score line 186' is about 0.008 inches. The distance 200' between the centers of the score lines, in this example, is approximately 0.050 inches, with the minimum width at the bottom of the outer score line 31' being approximately 0.002 inches and the minimum width at the bottom of the anti-fracture score line 186' being approximately 0.002 inches.

In the closing score lines 192' and 193' at the ends 33' of the score line, there will be suitable transitions to account for the difference in size, shape and score residual thickness between the outer score line 31' and the inner, anti-fracture score line 186', as will be understood. Exemplary closing score lines are indicated in FIGS. 20A and 20B.

Figure 20B:
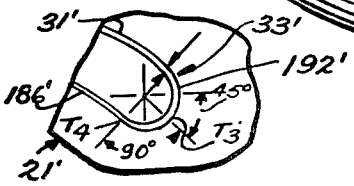
FIGS. 20A and 20B are enlarged and fragmentary plan views of the two ends of the score line shown in FIG. 20 and in generally the same orientation as for that figure.
Figure 20A:
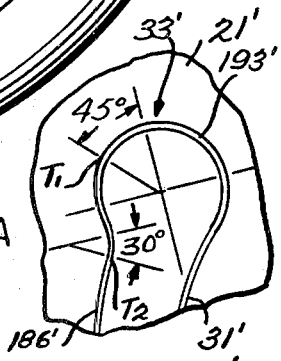

In FIG. 20A, closing score line 193' will be seen to be bulbous and generally circular in outline, and in vertical cross-section it is of the same size, shape and score residual thickness as outer score line 31' for the portion thereof covered by moving in a counterclockwise direction from outer score line 31' until it reaches the approximate position $T_1$ at which time it will gradually change in size, shape and score residual thickness until it reaches the end of the transition section as indicated approximately at about $T_2$, at which point it will be the same in vertical cross-section as the inner score line 186'. The diameter of the bulbous closing score line 193' in the example under consideration, is about 0.094 inches.

In FIG. 20B, closing score line 192' will be seen to be generally semicircular in outline and in vertical cross-section it is of the same size, shape and score residual thickness as outer score line 31' for the portion thereof covered by moving in a clockwise direction from outer score line 31' until it reaches the approximate position $T_3$ at which time it will gradually change in size, shape and score residual thickness until it reaches the end of the transition section, as indicated approximately at about $T_4$, at which point it will be the same in vertical cross-section as the inner score line 186'. The diameter of the closing score line 192' in the example under consideration, is about 0.050 inches.

the closing score lines 192' and 193' may be of any suitable score residual thickness for the purposes intended, as will be understood.

An embossment 213' is provided in the end wall 21' within the area bounded by the score line 30' and similar in outline thereto, but terminating in spaced ends, as shown in FIGS. 20 and 21. Embossment 213' may either be in the form of a raised surface in the end wall 21', as shown, or it may be formed as a depression therein. In any event, it serves the same purpose as the corresponding embossment 213M shown in FIGS. 16 and 71 and described hereinabove.

Wall 21' is also shown as including two ridges 214' straddling score line 30', as best seen in FIG. 20. These ridges 214' are provided for the same purpose as the reinforcing ridge 214M shown in FIGS. 16 and 17 and described above. Furthermore, wall 21' is formed with a curved, somewhat semicircular indentation 215' therein, serving essentially the same purpose as the indentation 215M shown in FIG. 16 and described above.

The embossments 213', 214', and 215' will function to take up loose metal resulting from the formation of the score lines and the rivet, as will be understood.

While the beads 214' and indentation 215', in the size and shape thereof shown in FIGS. 20 and 21, are believed to be advantageous, it will be understood that variations may be made therein without departing from the principles of the invention. Likewise, as should be evident, they may be formed either as indentations or as raised portions of the end wall, as desired, and the same is true as to the corresponding or similar structures shown in the other embodiments of the invention disclosed herein. It will also be understood that, if desired, the score line 30', as well as the other score line embodiments disclosed herein, may be formed on the inside surface of the end wall 21'.

The end wall 21' is shown as being provided with a rivet 43' for attachment to the tab 36', in a suitable manner, as indicated above for the embodiments shown in FIGS. 1–19. Tab 36' is made of any suitable stiff and strong material, such as an aluminum or ferrous alloy, for the purposes intended. In the embodiment thereof shown in FIGS. 20–25, it is preferably made of an aluminum alloy.

The tab 36' is shown as being of generally elongated outline having the forward rupturing portion 37' and rear lifting portion 38' with somewhat concave side portions 360, 361 extending therebetween. The forward rupturing portion 37' is shown as being circularly arcuate and overlies only a minor portion of the tear panel 35' defined by the score line 30', and with the front end or forwardmost tip of portion 37' being disposed over a place on the tear panel spaced from the rupturable score line 31'. It will be observed that in the example under consideration, the forward position 37' in its initial or original position, overlies the closing score line 193' as well as the hinge defined between closing score lines 192', 193', and it is tangent to the closing score line 192'.

The tab rear lifting portion 38' is shown as including an undulating or curved indentation 362 which may be utilized to facilitate insertion of a finger thereunder for lifting purposes. In that regard, a depression 390, as shown in FIGS. 20 and 21, may be formed in the end wall 21' beneath the rear portion 38'.

Tab 36' is shown as including a generally flat, depressed, main portion 201' having an upstanding peripheral ridge or flange 363 therearound and a generally U-shaped cut 61' formed therein with generally semicircular ends 206' defining therebetween an imaginary hinge or bend line for the tab. An attachment area 62' is provided by the cut 61' in the manner previously described.

The tab construction 36' is shown as including an insert 202', thus constituting a composite tab. As best seen in FIGS. 21 and 23–25, the insert includes a main body portion 364 substantially coextensive with the attachment area 62' defined by the cut 61', as well as a forward flaring portion 365 extending over a substantial part of the forward rupturing portion 37'. The insert main portion 364 and tab main portion 201' are respectively provided with aligned holes 366, 366' therein, to receive the rivet 43'.

Figure 23:
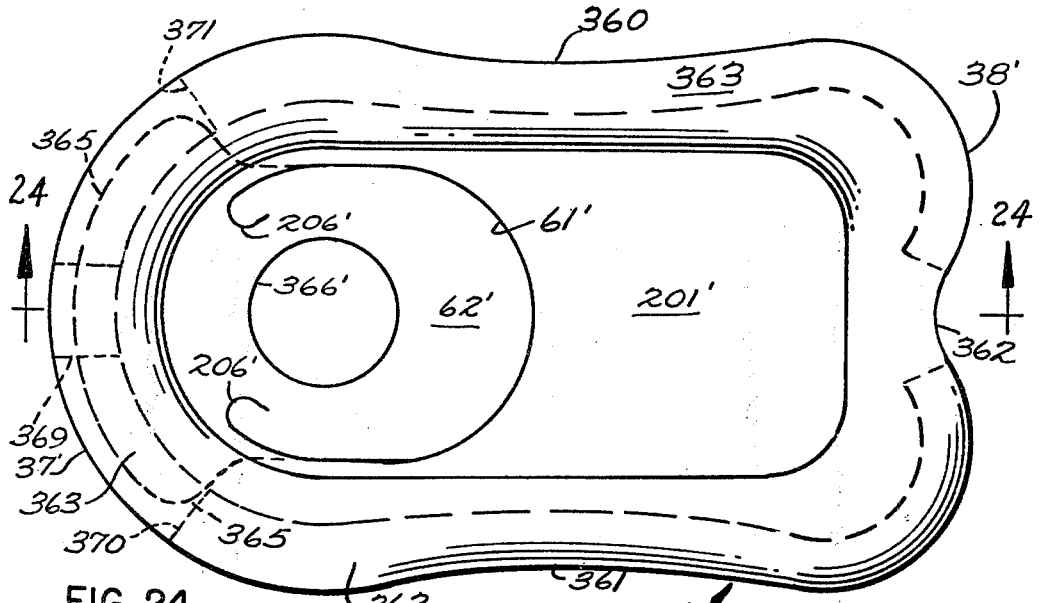
FIG. 23 is an enlarged top plan view of an exemplary embodiment of tab construction of this invention.
Figure 24:
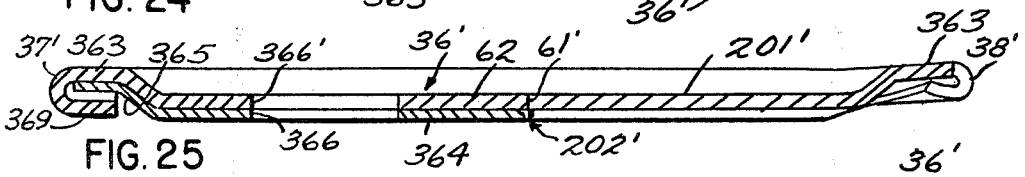
FIG. 24 is a vertical sectional view taken along line 24—24 of FIG. 23.
Figure 25:
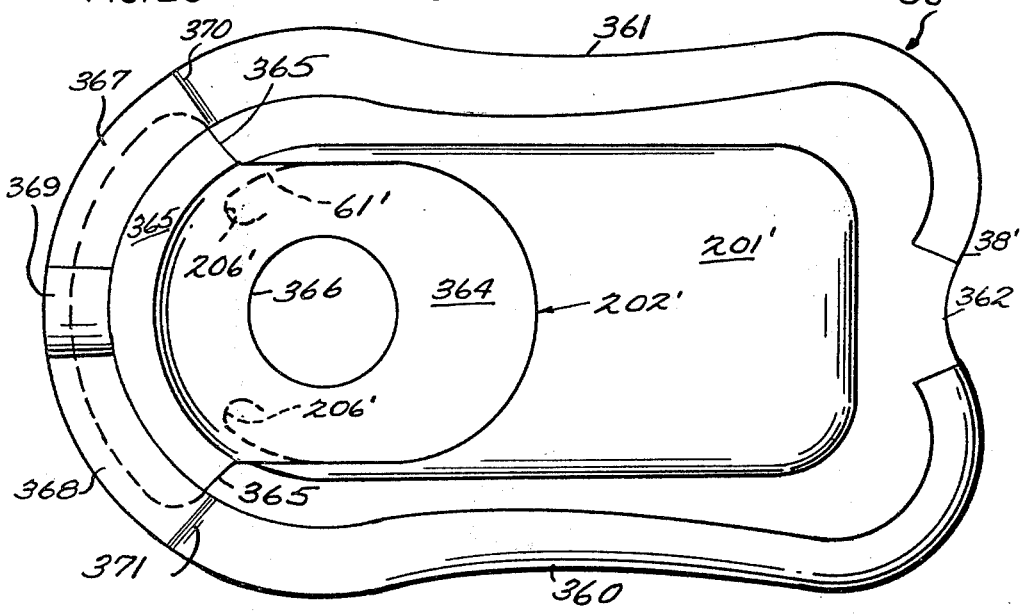
FIG. 25 is a bottom plan view of the tab of FIG. 23.

The tab flange 363 includes a portion curled or rolled thereunder to define a reinforcing bead or rib. As best seen in FIGS. 24 and 25, this curled portion also extends under and in engagement with the front edge of the flared portion 365 of insert 202'. In that regard, it will be noted that such edge follows the curvature of the tab in the region of the forward rupturing portion 37', as best seen in FIGS. 23–25.

The curled portion of the tab flange 363 in the region of the tab forward portion is flattened or crimped at 367 and 368 to grip and hold the insert 202' to the tab, thus making the composite tab a laminated construction. Crimped portions 367, 368 also provide a depending lobe 369 at the front tip of the tab, as well as lobe-like structures 370, 371 at the opposite ends of the portions 367, 368, as best seen in FIGS. 24 and 25. The purpose of these lobes will be evident as the description proceeds.

The insert 202' may be made of any suitable pliable material for retention of the tab to the end wall. In this preferred embodiment, both the tab 36' and the insert 202' are made of an alloy of aluminum with the tab being made out of a stiff and strong aluminum alloy, such as, for example, 5182-H19 with the insert 202' being made of, for example, a dead soft aluminum alloy, 8079-0. The tab 36' and insert 202' preferably are uncoated (i.e., bare metal) and may be of any desired thickness, such as about 0.010 inches for insert 202' and about 0.0186 inches for tab 36'.

The flared sides of forward portion 365 of the insert 202' are disposed forwardly of the imaginary hinge line extending between the cut ends 206' so as not to interfere with the pivoting of the tab for opening the container.

The composite tab construction 36', 202' may be made by any suitable method, which method is not part of the present invention. It will be understood, though, that the tabs 36' and inserts 202' may be formed out of suitable sheet or strip metal stock by appropriate dies (not shown) and suitably held together prior to forming the peripheral reinforcing rib or bead on the tab so that the final tab construction may be shown in FIGS. 23 – 25.

As indicated heretofore, an all-aluminous metal construction is preferred. However, the insert 202' may alternatively be constructed of a suitable plastic material, for example, polypropylene or high density polyethylene, to achieve the same purpose of increasing the resistance of the composite tab construction to fatigue failure.

The insert 202', whether made of metal or plastic, will be suitably held to the tab 36' to constitute a composite or laminated tab construction, as indicated above for the metal insert 202'.

It will be evident that the composite tab construction shown in FIGS. 23–25 and as described herein may be utilized in place of any of the tab constructions shown in the embodiments of FIGS. 1–19.

As an alternative tab construction, the tab 36' may be made with the main portion 201' thereof omitted, so as to comprise only the peripheral flange 363 and attachment area 62', if desired. In that case, the outline of the peripheral flange 363 and its size and shape may be varied for strength or other purposes, as will be appreciated. In that regard, reference may be made to the tab construction disclosed in my U.S. Pat. No. 3,799,390, granted Mar. 26, 1974 on an application filed Dec. 21, 1971.

In the operation of the embodiments shown in FIGS. 20–25, a finger may be inserted under or against the tab rear lifting portion 38' to start the opening process. During the initial lifting phase the depending lobe 369 at the tip of the tab forward rupturing portion 37' will be brought into pressure contact with an unscored area of the tear panel 35', as indicated in FIGS. 20–21, and this pressure contact will be facilitated by reason of the pressure inside the container when same contains a pressurized beverage such as a soft drink or beer. This initial lifting of the tab rear portion has been observed to involve a generally second-class lever action wherein the fulcrum will be substantially in the region of the area of contact between the tab depending lobe 369 and the tear panel 35' so as to cause a lifting of the rivet 43' and adjacent portions of the end wall 21' while the lobe 369 is pressing down on the tear panel 35'. As the tab rear portion is lifted farther, more pressure will be exerted by the depending lobe 369 against the tear panel, there will be a greater tendency to lift the rivet and adjacent portions of the end wall 21' and there will be some bending of the tab along the imaginary hinge line between the cut ends 206'. This generally second-class lever action will continue until sufficient forces are generated to cause an initial rupturing of the undulating or curved portion 176' of the score line in the vicinity of the rivet 43'. This initial rupturing may be considered as extending along a ruptured length approximately defined within an arc such as the arc 182K in FIG. 5. Further, the initial rupturing, in the exemplary construction under consideration, has been observed to extend into the closing score line 193' to about the point $T_1$, as shown in FIG. 20A.

Figure 6:
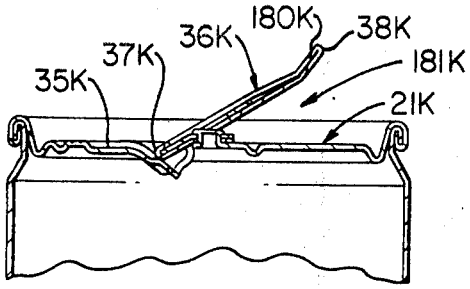
FIG. 6 is a fragmentary cross-sectional view taken essentially on the line 6—6 of FIG. 5.

It is believed that the aforesaid initial rupturing is caused essentially by tensile action and is achieved upon lifting the tab rear portion 38' approximately to the position illustrated for tab 38K in FIG. 6. It will be appreciated that the depending lobe 369 will help to reduce the force required to achieve initial rupturing, for example, by localizing the area of pressure contact between the tab front portion and the tear panel.

Figure 8:
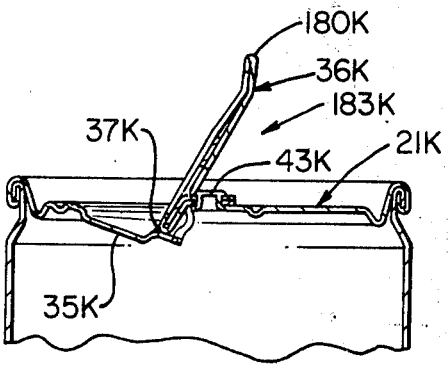
FIG. 8 is a fragmentary cross-sectional view taken essentially on the line 8—8 of FIG. 7.

Continued lifting of the tab 36', for example, to the position illustrated for tab 36K in FIG. 8, results in propagation of the initial rupturing along a larger length, for example, as indicated approximately by arc 184' in FIG. 20. The further rupturing involved is believed to be caused essentially by shearing action.

Figure 9:
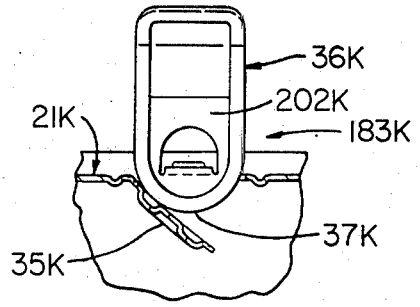
FIG. 9 is a fragmentary view taken essentially on the line 9—9 of FIG. 7.
Figure 7:
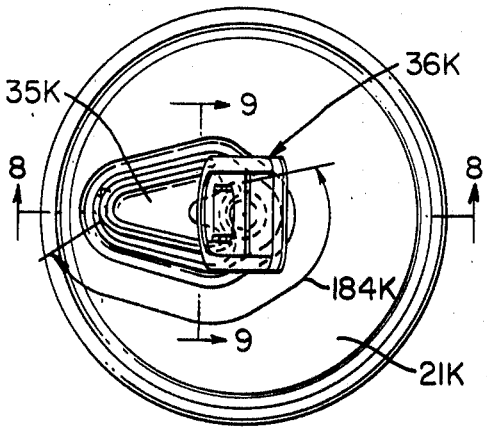
FIG. 7 is a top plan view similar to FIG. 5 illustrating the tab raised an additional angular increment from the plane of the container top wall.
Figure 10:
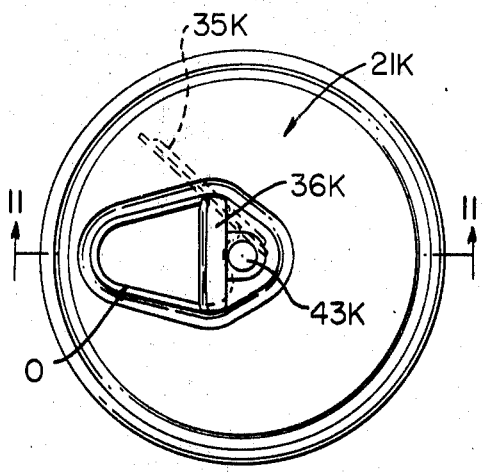
FIG. 10 is a view similar to FIG. 7 illustrating the tab raised to a vertical position whereupon the severable panel is severed and remains attached only at a corner thereof.

Further lifting of the tab through a comparatively small angular increment so that it is in a substantially vertical position, as indicated for tab 36K in FIG. 11, results in substantially instantaneous rupturing of the remainder of the scored portion of the panel 35' in what might be considered a snap action whereupon the panel 35' is depressed downwardly, transverse to the wall 21', for example to a position approximately corresponding to the position of panel 36K indicated in FIG. 9. This latter rupturing is also believed to be caused essentially by shearing action, and the rupturing thus will extend between the spaced ends 33' of the score line with some rupturing extending into the curved transition ends, as previously indicated.

While the description of the opening operation for the embodiments of FIGS. 20–25 has proceeded as if the rupturing of the panel 35' were achieved in incremental steps or the like, it is to be understood that such severing is usually achieved in substantially one smooth motion producing a "snap-opening" of wall 21'. In that regard, after the initial rupturing occurs (during which the tab has been observed to function generally as a second-class lever with the fulcrum essentially at the depending lobe 369 at the front tip of the tab, as noted above), further lifting of the tab rear portion is effected with the tab functioning generally as a first-class lever with the fulcrum disposed in the region of the rivet 43 and substantially along the imaginary hinge line between the ends 206' of the U-shaped cut 61' of the tab. Furthermore, as the rupturing of the score line is propagated from the initial rupturing in the undulating portion 176' and along the adjacent side portion 216', the periphery of the flange 363 and reinforcing bead between the lobes 369 and 371 is pressed into progressive, sliding contact with the panel 35' to cause propagation of the rupturing of the score line from side portion 216' through the arcuate portion 217' and through the opposite side portion 216', all the way to the other end 33', 192', with the panel 35' bending about the wall portion 34'. When the tab reaches the vertical or substantially vertical position, as indicated in FIG. 11 for tab 36K, side lobe 371 on the tab forward portion will be in contact with the wall portion 34' to be sure that the tear panel 35' is opened, and the tear has been observed to extend into closing score line 192' to about point $T_3$, as shown in FIG. 20B.

The tab 36' may be pivoted through an angle greater than 90° in connection with opening, whereby the tab in the area of lobe 371 will press against the area of the tear panel defined by wall portion 34' so as to swing or depress the tear panel 35' down to a more open position where the tear panel is in substantially a vertical plane, as indicated, for example, by the position of the tear panel 35K shown in FIG. 12.

Figure 22:
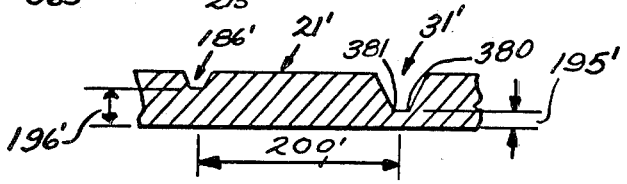
FIG. 22 is an enlarged and fragmentary vertical sectional view taken along line 22—22 of FIG. 20.

It has been found that upon opening of the tear panel 35', in the manner described, the initial tear line occurs along the outside corner 380 of the bottom of the score line 31', as shown in FIG. 22 and that the tear will continue in that corner until approximately point $P_1$ is reached, as indicated in FIG. 20. Thereafter, and approximately until point $P_2$ in FIG. 20 is reached, the line of severing appears to shift over to the inner corner 381 of the bottom of the score line 31', at which point it is sharply transferred back to the outer corner 380 for the rest of the severing to the other end 33', 192'.

The apparent changeovers of the line of rupturing, just referred to, even if resulting in a sharply defined edge, as at point $P_2$, are so small as to be hardly noticeable.

After the tear panel 35' has been opened, in the manner described, the tab 36' may be pivoted back about the imaginary hinge line between cut ends 206' toward a flat or substantially flat position, as indicated in FIGS. 20–21 so as to be out of the way for pouring or drinking purposes.

The foregoing description of the opening function of the tab 36' is also essentially applicable for the tabs 36K, 36L, 36M (and 36N, not shown) in the embodiments of FIGS. 1–19 described hereinabove.

Thus, it will be seen that even though the forward rupturing portion of the tab overlies only a minor part of the tear panel in all of the embodiments herein, with the front end or tip of the tab overlying an unscored region, actuation of the tabs will nevertheless effect a complete rupture of the rupturable score line. Furthermore, upon returning the tab toward a flat or substantially flat position, after opening the tear panel, the tear panel will remain in its opened position and the opening will not be significantly obstructed by the tab forward portion.

The unique construction of the tab and tear panel, including having the unscored wall portion defining the tear panel hinge arranged to one side of the rivet and in the vicinity of the tab forward portion, is believed to significantly reduce the forces required for opening the tear panel while still providing a satisfactory opening for pouring or drinking.

The composite construction of the tab disclosed hereinabove will improve retention of that structure on the end wall in the event repeated flexings should result in tearing of the main body portion of the tab from the attachment area, for example, in the region of the imaginary hinge line between ends 206' in FIG. 23. In that event, the insert, for example 202' in the FIGS. 20–25 embodiment, will still be intact and will function to retain the composite tab to the can end.

As indicated above, it has been found that by reason of the design of the closing score line 193', the initial tear of the outer score line 31' will terminate at one end at about the point $T_1$ as indicated in FIG. 20A so that the tear does not propagate into the unscored bend area 34'. The same is also true with respect to the corresponding structures of the other embodiments disclosed herein.

The end walls of this invention preferably are initially formed so as to be essentially flat, as indicated, for example, in FIGS. 3 and 21. When they are seamed to the side wall of a container having a pressurized beverage therein, the end wall will be distended or domed upwardly by the pressure therein. This will provide additional clearance between the rear portion of the tab and the end wall to facilitate actuation of the tab. When the tear panel is ruptured, the pressure in the container will be vented and the end wall will return to a substantially flat or planar condition. The upward doming of the end walls of the present invention, as just described, has been found to facilitate the rupturing of the tear panel. Furthermore, after the tear panel has been ruptured and the container vented, the return of the end wall to a substantially flat position also provides for return of the tab to a substantially flat position where it will be disposed substantially below the plane of the chime of the end wall.

It might also be noted that because of the unique construction of the tabs and tear panels of the present invention, venting of the contents of the container will occur during the initial rupturing described above, for example, along the undulating or curved section 176' shown in FIG. 20. The spray which normally accompanies such venting will then be directed against the under-surface of the tab which thus acts as a shield to protect the user from the spray, even if undesirably high pressures had developed inside the container, as by agitation.

Furthermore, by not having the forward part of the tab which presses down on the tear panel when initially rupturing the tear panel, directly overlie any portion of the score line, protection will be afforded against accidental or premature venting of the container, should the front of the tab be accidentally pressed down during handling, shipping, storage and the like. In that regard, it has been found that even with the application of relatively high inwardly or downwardly directed forces on the tear panel in the region thereof under the front end of the tab and without any concurrent lifting of the container end wall in the region of the rivet and curved score line portion 176', no rupturing of the score line occurs.

It will be observed that other proposed end wall constructions require use of a finger or other implement in connection with movement of a non-detachable tear panel to its fully opened position, whereas the ends disclosed herein can be fully opened through operation of the tab alone. Fully opening the end by means of the tab alone appears to have distinct advantages over use of a finger or other implement, for example, as regards convenience and sanitation.

It will further be observed that still other currently proposed end wall constructions have two rivets to secure the tab, whereas the ends disclosed herein have the tab secured with a single rivet. The use of a single rivet instead of multiple rivets is distinctly advantageous for purposes of reducing difficulty of manufacture and risk of rivet leaks.

As noted above, the term "aluminous" metal or material, as used herein, refers to aluminum alloys, and the term "aluminum alloy(s)" refers to commercial purity aluminum and alloys containing more than 50 percent aluminum. The preferred material for all components of the invention is aluminous metal. The end wall is preferably made of a strong aluminum alloy which has been strengthened by cold work (e.g. 5182 -H19), although an aluminum alloy strengthened by heat treatment might also be considered (e.g. 6061-T4). The component of the tab selected for strength is preferably made of an aluminum alloy such as described as suitable for the end wall (e.g. 5182-H19). The tab insert selected to resist repeated bending and reverse bending is preferably made of an aluminum alloy which has been annealed (preferably 8079-0).

While present exemplary embodiments of this invention, and methods of practicing the same, have been illustrated and described it will be recognized that this invention may be otherwise variously embodied and practiced within the scope of the following claims.

What is claimed is:

1. An easy-open container end with non-detachable means for making an opening therethrough suitable for pouring, comprising:

an end wall, a rupturable score line in the end wall defining most of the periphery of a nonremovable tear panel, while leaving an integral hinge between the panel and the remainder of the end wall, said score line extending away from one end of the hinge, around a bight where it is distant from the hinge, and back to the other end of the hinge, a tab extending generally parallel and close to an underlying area of the end wall, a rear part of the tab being engageable for upward lifting, and a forward part of the tab overlying a minor portion of the tear panel, and attaching means on the end wall in a region thereof adjacent the score line and outside the tear panel, said attaching means being nondetachably secured to connecting means on the tab, said attaching and connecting means permitting pivotal movement of the tab when the rear part of the tab is lifted up from the container and, while the forward end of the tab correspondingly swings down, the score line being subject to initial rupture when the rear end of the tab is partially lifted to cause the forward end of the tab to press down on the panel, continued pivotal movement of the tab, about an axis generally parallel to the underlying area of the end wall and close to the said attaching means, being effective to propagate the rupture of the score line, and to swing the panel down about its hinge to open position, and said attaching means on the end wall being closer to said hinge than to a place on the tear panel where the forward part of the tab is adapted to press initially.

2. The structure defined in claim 1 wherein the greater part of said tear panel is outside of the area covered by the tab in its initial position and extends away from said area toward said bight, wherein said initial rupture of the score line occurs in a region adjacent one end of said hinge and further wherein the initial rupture is propagated throughout the entire length of the score line between the ends of said hinge.

3. The structure defined in claim 2 wherein said attaching means comprises a rivet integrally formed in about the center of said end wall.

4. The structure defined in claim 2 wherein said tab forward part has a generally arcuate periphery that is urged against the tear panel as said tab rear part is lifted up to effect said initial rupture and the propagation thereof.

5. The structure defined in claim 2 wherein said tab is adapted to be returned toward a position generally parallel and close to an underlying area of the end wall, after the score line is ruptured, and the tear panel is swung downwardly, without causing return movement of said tear panel toward said end wall.

6. The structure defined in claim 1 wherein the length of said hinge is substantially less than the maximum dimension of the tear panel.

7. The structure defined in claim 1 wherein said tab comprises: a first member of a first material; a second member of a second material; means for connecting said tab to said attaching means and including a portion bendable for permitting said pivotal movement of said tab; said bendable portion comprising parts of said first and second members; said first material having greater strength than said second material; and said second material being more capable of being bent back and forth without breaking than said first material.

8. A container end according to claim 1 wherein said place on the tear panel where the forward part of the tab initially presses is spaced from the score line, and wherein said attaching means on the end wall is close to the score line.

9. A container end according to claim 1 wherein said forward part of the tab overlies at least a portion of said hinge.

10. A container end according to claim 1 wherein said attaching means on the end wall is a rivet integral with the end wall, and said connecting means on the tab comprises a connection having a hole receiving the rivet.

11. A container end according to claim 1 wherein said attaching means on the end wall is a rivet integral with the end wall, and said connecting means on the tab comprises a bendable extension of the tab secured to the rivet.

12. A container end according to claim 11 wherein the initially rupturable part of the score line extends closely around the side of the rivet facing said place on the tear panel where the forward part of the tab initially presses.

13. A container end according to claim 11 wherein said rupturable score line has two spaced ends defining said hinge, with one said end being close to said rivet.

14. A container end according to claim 13 wherein the other end of said rupturable score line is located substantially at a point beneath an edge of the forward part of the tab.

15. A container end according to claim 13 wherein a second score line providing greater residual wall thickness in said end wall than said rupturable score line extends in closely spaced relation alongside the length of the rupturable score line, each of the two score lines terminating at each end in an arcuate closing score line connecting the two adjacent ends.

16. A container end according to claim 11 wherein said initial rupture of the score line occurs adjacent the rivet when the tab extension pulls up on the rivet.

17. A container end according to claim 16 wherein the path of the score line is generally circular outside of the area covered by the tab in its initial position.

18. An easy-open end wall for a beverage container, said end wall having a periphery, a rupturable score line in said end wall defining most of the periphery of a non-removable tear panel while leaving an integral hinge between the panel and the remainder of the end wall, a non-detachable tab, means for attaching said tab to said end wall in a region adjacent to but outside of said tear panel and providing for pivotal movement of said tab about an axis transverse to the length of said tab, said score line including two spaced portions extending from said region away from said tab, said score line extending from said two spaced portions into a generally arcuate section, said tab having a forward, rupturing portion that overlies a minor part of said tear panel adjacent said region with the greater part of said tear panel being uncovered by and extending away from said tab toward said generally arcuate section, and with the front end of said tab forward portion not overlying any portion of said rupturable score line when said tab is in its original position, said tab having a rear portion being adapted to be easily grasped and lifted up to urge said forward portion against said panel as the tab is pivoted about said axis to rupture said score line and depress said panel away from said end wall and about its hinge to open position, the initial lifting movement of said tab rear portion effecting an initial rupturing of said score line adjacent said tab forward portion and further lifting of said tab rear portion causing propagation of the initial rupturing of the score line away from said tab forward portion and into said generally arcuate section of said score line, and said tab forward portion being adapted to press initially against said tear panel at a place spaced from said rupturable score line.

19. The structure defined in claim 18 wherein said two spaced portions of said score line diverge as they extend outwardly from said region.

20. The structure defined in claim 18 wherein said means for attaching said tab to said end wall comprises a rivet formed in about the center of said end wall and adjacent said tear panel.

21. The structure defined in claim 18 wherein propagation of the initial rupturing of the score line is effected through one of said two spaced portions then through said generally arcuate section, then through the other of said two spaced portions of said score line.

22. The structure defined in claim 21 wherein said tab forward rupturing portion has a generally semicircular periphery that is urged against the tear panel as said tab rear portion is lifted up to effect said initial rupturing and said propagation.

23. The structure defined in claim 22 wherein said tab forward rupturing portion overlies at least one of said two spaced portions of said score line.

24. The structure defined in claim 21 wherein said tab is arranged in a position substantially flat with respect to the underlying area of said end wall prior to opening and is adapted to be returned toward that position after depressing said tear panel and without causing return movement of said tear panel towards said end wall.

25. The structure defined in claim 18 wherein said tab comprises: a first member of a first material extending substantially the length of the tab and providing rigidity against transverse bending; a second member of a second material; said means for attaching said tab and providing for said pivotal movement thereof comprising means for connecting said tab to attachment means on said end wall and including a portion bendable for permitting said pivotal movement; said bendable portion comprising parts of said first and second members; said first material having greater strength than said second material; and said second material being more capable of being bent back and forth without breaking than said first material.

26. A tab suitable for levering open a tear panel on an end wall of an easy-open container without being detached from the container, said tab having a rear end adapted to be lifted to open a tear panel and a front end adapted to be pressed down on a tear panel and comrising: a first member of a first material extending substantially the length of said tab between its ends and providing rigidity against transverse bending when the tab is used as a lever; a second member of a second material; said first and second members being mechanically joined together by overlap of a marginal portion of said first member around a marginal portion of said second member, said members having other portions thereof which have aligned openings therethrough for receiving a rivet from a container end wall and which are bendable for permitting pivotal movement of said tab about an axis transverse to said length; said first material having greater strength than said second material; and said second material being more capable of being bent back and forth without breaking than first material.

27. The structure defined in claim 26 wherein said first member has a generally arcuate front end constituting said tab front end and having opposite sides extending toward the rear of the tab; said arcuate front end of said first member having an outer margin overlapping and gripping a corresponding outer margin of said second member to mechanically join said members together.

28. The structure defined in claim 17 wherein said first and second members are made of aluminous materials.

29. The structure defined in claim 1 wherein said container end wall and said tab are made of aluminous materials.

30. The structure defined in claim 7 wherein said container end wall and said first member and said second member are made of aluminous materials.

31. The structure defined in claim 18 wherein said container end wall and said tab are made of aluminous materials.

32. The structure defined in claim 25 wherein said container end wall and said first member and said second member are made of aluminous materials.

* * * * *

UNITED STATES PATENT OFFICE

CERTIFICATE OF CORRECTION

Patent No. 3,967,752 Dated July 6, 1976

Inventor(s) Daniel F. Cudzik

It is certified that error appears in the above-identified patent and that said Letters Patent are hereby corrected as shown below:

Column 11, line 30, change "the" to --The--.

Column 12, line 17, change "position" to --portion--.

Column 13, line 19, after "be" insert --as--.

Column 14, line 33, change "36K" to --35K--.

Column 15, line 6 after "panel" insert --hinge--.

Column 20, line 44, change "17" to --27--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*